US011482198B2

(12) United States Patent
Vaccaro, Jr.

(10) Patent No.: US 11,482,198 B2
(45) Date of Patent: Oct. 25, 2022

(54) INTERCHANGEABLE HEAD ASSEMBLY FOR MUSICAL INSTRUMENTS

(71) Applicant: Vaccaro Guitar LLC, Neptune, NJ (US)

(72) Inventor: Henry Victor Vaccaro, Jr., Allenhurst, NJ (US)

(73) Assignee: Vaccaro Guitar LLC, Neptune, NJ (US)

( * ) Notice: Subject to any disclaimer, the term of this patent is extended or adjusted under 35 U.S.C. 154(b) by 0 days.

(21) Appl. No.: 17/201,324

(22) Filed: Mar. 15, 2021

(65) Prior Publication Data

US 2022/0293069 A1 Sep. 15, 2022

(51) Int. Cl.

| | |
|---|---|
| ***G10D 3/02*** | (2006.01) |
| ***G10D 3/095*** | (2020.01) |
| ***G10D 1/08*** | (2006.01) |
| ***G10D 3/22*** | (2020.01) |

(52) U.S. Cl.

CPC ..... *G10D 3/095* (2020.02); *G10D 1/08* (2013.01); *G10D 3/22* (2020.02)

(58) Field of Classification Search

CPC ..... G10D 3/095; G10D 1/08; G10D 3/22; G10D 1/00

See application file for complete search history.

(56) References Cited

U.S. PATENT DOCUMENTS

| | | | |
|---|---|---|---|
| 3,915,049 | A | 10/1975 | Bean |
| 4,121,492 | A | 10/1978 | Berardi et al. |
| 4,846,038 | A | 7/1989 | Turner |
| 5,018,423 | A | 5/1991 | Bunker |
| 5,421,233 | A | 6/1995 | Bunker |
| 5,753,837 | A | 5/1998 | Petillo et al. |
| 5,804,753 | A | 9/1998 | Speer |
| 6,046,392 | A | 4/2000 | Saul |
| 6,046,393 | A | 4/2000 | Rose |

(Continued)

FOREIGN PATENT DOCUMENTS

EP 3340231 A1 6/2018

OTHER PUBLICATIONS

Taran Guitars, "Development—New Neck Joints", Retrieved from: https://www.taranguitars.co.uk/blogposts/2018/10/4/developments-new-neck-joint Retreived on: Feb. 17, 2021 (8 pages total).

(Continued)

*Primary Examiner* — Kimberly R Lockett

(74) *Attorney, Agent, or Firm* — John Maldjian; Stevens & Lee PC

(57) ABSTRACT

Stringed musical instruments and methods of manufacture. An instrument includes a body, a neck extending from the body, and a head extending from the neck. The head and the neck attach to one another with a mortise and tenon joint or a dovetail joint. The head and neck may be removably or permanently attachable to one another. The body and neck may also attach to one another with a mortise and tenon joint or a dovetail joint. A truss rod may extend from the neck to secure the head and neck to one another. The body, neck, head, or portions thereof may be manufactured from aluminum and/or a combination of metals. A neck assembly may include a reinforced spine, a grip member, a fretted fingerboard, and a tenon tongue or a dovetail pin extending from an end of the spine.

20 Claims, 7 Drawing Sheets

(56) References Cited

U.S. PATENT DOCUMENTS

| | | | | |
|---|---|---|---|---|
| 6,051,765 | A | 4/2000 | Regenberg et al. | |
| 7,326,838 | B1 | 2/2008 | Bunker | |
| 7,557,281 | B1 | 7/2009 | Campling | |
| 7,659,464 | B1 | 2/2010 | Kokodis | |
| 8,759,649 | B2 | 6/2014 | Potyrala | |
| 9,721,543 | B1 | 8/2017 | White | |
| 10,467,993 | B2 | 11/2019 | Canivell Grifols | |
| 10,475,420 | B1 * | 11/2019 | Stadnyk | G10D 1/085 |
| 10,803,840 | B1 | 10/2020 | Greene et al. | |

OTHER PUBLICATIONS

The Fellowship of Acoustics, "To dovetail or to bolt on, that's the question", posted Jul. 30, 2020, Retrieved from: https://www.tfoa.eu/en/blogs/blog/to-dovetail-or-to-bolt-on-thats-the-question/ Retrieved on: Feb. 17, 2021 (8 pages total).

Philadelphia Luthier Tools and Supplies, "Hybrid Titanium/Steel Truss Rod—Lighter Weight—item description" Retrieved from: https://www.philadelphialuthiertools.com/truss-rods-washers-and-nuts/hybrid-titanium-steel-truss-rod-lighter-weight/ Retrieved on: Feb. 17, 2021 3 pages total).

* cited by examiner

INTERCHANGEABLE HEAD ASSEMBLY FOR MUSICAL INSTRUMENTS

BACKGROUND

A guitar includes a body, a neck extending from the body, a head extending from the neck, and strings extending between the body and the head. Tension of the strings may cause warpage or other damage to the neck and/or the head.

Conventionally, the neck and the body are bolted to one another, whereas the neck and head are manufactured to form an integral instrument, such that neither the neck nor the head are separable from one another. Thus, neither the neck nor the head is head is individually replaceable.

SUMMARY

Stringed musical instruments and methods of manufacture are disclosed herein. A stringed musical instrument includes a body, a neck extending from the body, and a head extending from the neck. The head and the neck attach to one another with a mortise and tenon joint or a dovetail joint. The head and neck may be removably or permanently attachable to one another. The body and neck may also attach to one another with a mortise and tenon joint or a dovetail joint, removably or permanently. A truss rod may extend from the neck to secure the head and neck to one another. The body, neck, head, or portions thereof may be manufactured from aluminum. A neck assembly may include a reinforced spine, a grip member, a fretted fingerboard, and a tenon tongue or a dovetail pin extending from an end of the spine.

BRIEF DESCRIPTION OF THE DRAWINGS/FIGURES

Figure 1:
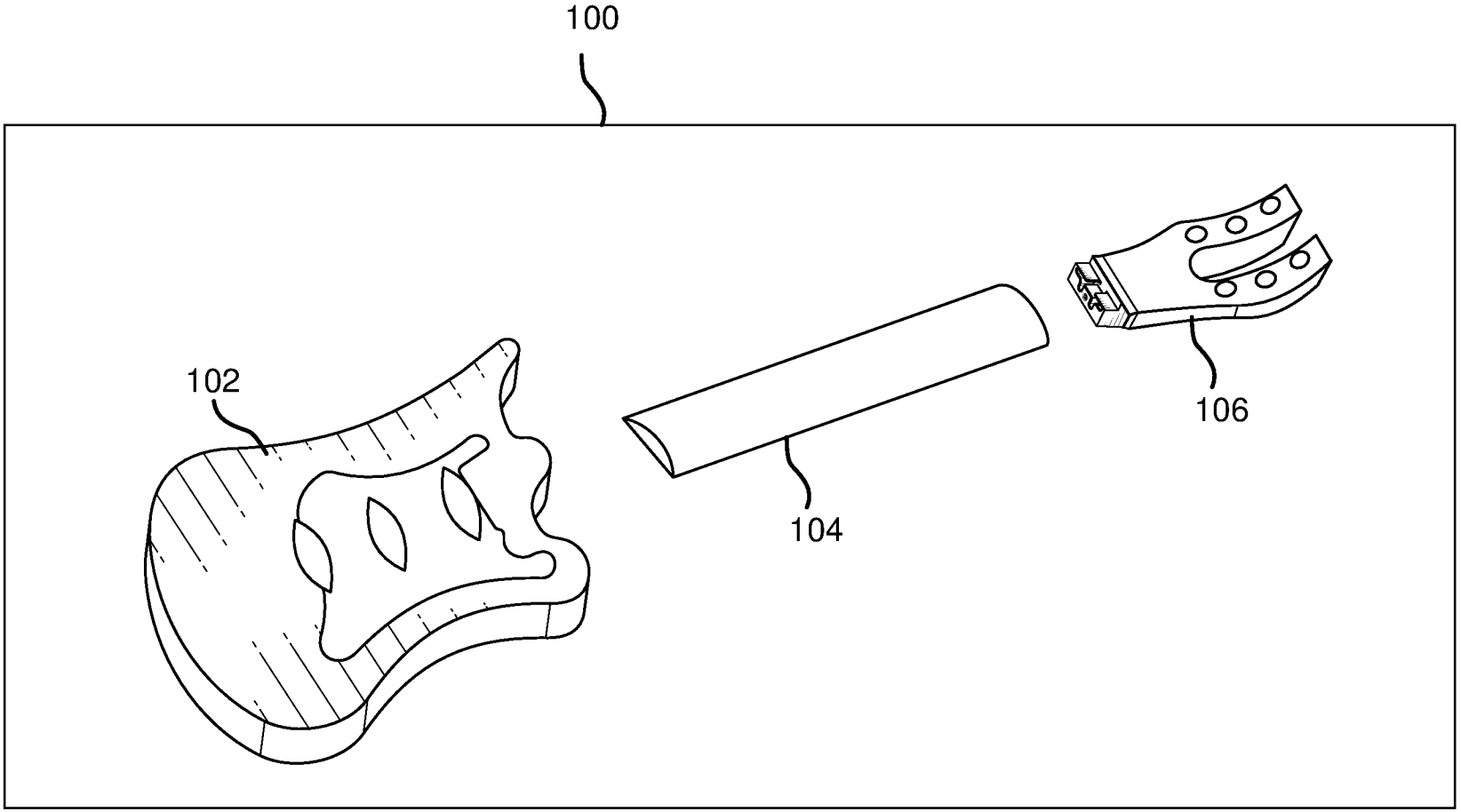
FIG. 1 is a perspective view of an example stringed musical instrument that includes a body, a neck, and a head.

In the drawings, the leftmost digit(s) of a reference number identifies the drawing in which the reference number first appears.

DETAILED DESCRIPTION

FIG. 1 is a perspective view of an example stringed musical instrument (instrument) 100. Instrument 100 includes a body 102, a neck 104, and a head 106.

Instrument 100 further include strings that extend between body 102 and head 106, examples of which are provided further below.

In the example of FIG. 1, instrument 100 is illustrated as a guitar. Features disclosed herein are not, however, limited to guitars. Features disclosed herein may be applied to a variety of other types of stringed musical instruments including, for example and without limitation, a viola, a cello, a double bass, a banjo, a mandolin, a ukulele, and/or other instrument(s).

Head 106 and neck 104, and/or body 102 and neck 104, may be removably attachable to one another, such as with a mortise and tenon joint, a dovetail joint, and/or other joint types (e.g., tongue and groove and/or box joint). In other words, head 106 and neck 104, and/or body 102 and neck 104, may be detachable from one another by a user. In this way, body 102, neck 104, and/or head 106 may be replaceable/interchangeable with other suitably designed/manufactured pieces.

Where head 106 and neck 104 are configured to attach to one another with a mortise and tenon joint, a surface of head 106 or neck 104 has an opening to a mortise cavity, and the other one of head 106 and neck 104 includes a tenon tongue extending from a surface thereof configured to slide through the opening and fit within the mortise cavity.

Where head 106 and neck 104 are configured to attach to one another with a dovetail joint, a surface of head 106 or neck 104 has an opening to a trapezoidal-shaped cavity, and the other one of head 106 and neck 104 includes a trapezoidal-shaped pin extending from a surface thereof configured to slide through the opening and fit within the trapezoidal-shaped cavity, in a direction that is perpendicular to a length of neck 104.

Where body 102 and neck 104 are configured to attach to one another with a mortise and tenon joint, a surface of body 102 or neck 104 has an opening to a mortise cavity, and the other one of body 102 and neck 104 includes a tenon tongue extending from a surface thereof configured to slide through the opening and fit within the mortise cavity.

Where body 102 and neck 104 are configured to attach to one another with a dovetail joint, a surface of body 102 or neck 104 has an opening to a trapezoidal-shaped cavity, and the other one of body 102 and neck 104 includes a trapezoidal-shaped pin extending from a surface thereof configured to slide through the opening and fit within the trapezoidal-shaped cavity, in a direction that is perpendicular to a length of neck 104.

In an embodiment, body 102 and neck 104 are bolted to one another.

Examples are provided below in which a head and neck are configured to attach to one another with a mortise and tenon joint, and with a dovetail joint. Apparatuses and methods disclosed herein are not, however, limited to these examples.

In an embodiment, a tenon tongue includes a pair of flanges extending away from one another and/or a pair of flanges in parallel with one another, an example of which is provided below with reference to FIG. 2.

Figure 2:
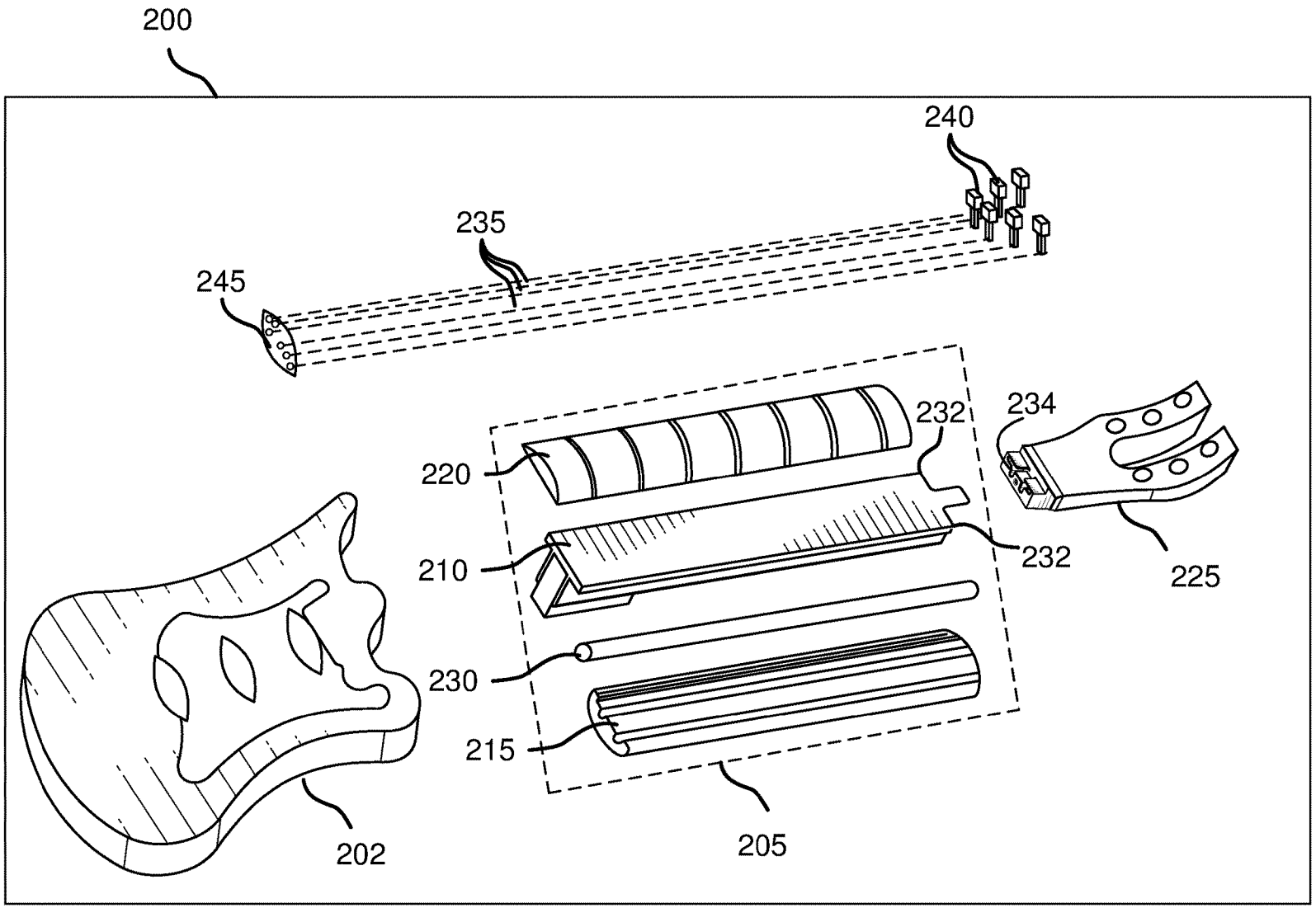
FIG. 2 is a perspective view of another example stringed musical instrument.

FIG. 2 is a perspective view of an example stringed musical instrument (instrument) 200. Instrument 200 includes a body 202, a neck assembly 205 configured to extend from body 202, and a head 225 configured to extend from neck assembly 205. Instrument 200 further includes tuning keys 240 and pins 245 to hold strings 235.

In the example of FIG. 2, neck assembly 205 includes a grip member 215, a spine 210, a fingerboard 220, and a truss rod 230. Spine 210 may be positioned between grip member 215 and fingerboard 220.

Further in the example of FIG. 2, head 225 and neck assembly 205 are configured to attach to one another with a mortise and tenon joint. Specifically, spine 205 includes a mortise tongue configured to fit within a mortise cavity 234 of head 225. The mortise tongue is illustrated here as including a pair of flanges 232 that extend away from one another. Such an embodiment is referred to herein as an elongated double flanged spine. Spine 210 is not, however, limited to the elongated double flanged example of FIG. 2.

Body 202, neck assembly 205, head 225, or portions thereof, may be constructed from aluminum. For example, spine 210 and at least a portion of head 225 may be constructed of aluminum. Such an embodiment may be substantially stronger than an all-wooden construction and may be less likely to warp or break. Such an embodiment may also provide a unique sound that may not be attainable in an all-wood embodiment. Alternatively, or additionally, head 225, spine 210, or portions thereof may be fabricated from other substantially rigid material(s), such as, without limitation, a plastic, a composite material, magnesium, and/or other material(s).

Body 202, grip member 225, fingerboard 220, or portions thereof may be made from a hardwood (e.g., such as maple, oak, teak, or rosewood), a plastic, a composite material, and/or other material(s). Implementing grip member 215, fingerboard 220, or portions thereof with a material other than aluminum may provide a warmer feel to a hand of a musician as compared to aluminum.

Embodiments that utilize aluminum may be implemented without substantially impacting a weight of a stringed musical instrument. Apparatuses and methods disclosed herein are not limited to the aluminum examples provided herein.

In FIG. 2, truss rod 230 may extend along a length of neck assembly 205. Truss rod 230 may be positioned within or adjacent to spine 210. Truss rod 230 may be configured to control a bend of neck assembly 205. Truss rod 230 may be configured to stabilize a lengthwise forward curvature (e.g., a relief) of neck assembly 205. Truss rod 230 may be adjustable to provide tension in neck assembly 205 to counter forces from the pulling of strings 235. This may help keep neck assembly 205 straight.

Truss rod 230 may be further configured to releasably secure head 225 and neck assembly 205 to one another. Truss rod 230 may, for example, include a threaded end configured to extend from neck assembly 205, and head 225 may have a threaded cavity adjacent to opening 234 to receive the threaded end of truss rod 230.

Truss rod 230 may include an adjustable metal bar/rod (e.g., steel or titanium) that extends lengthwise through neck assembly 205, and a nut assembly may be provided at one or both ends of truss rod 230 to adjust a tension of truss rod 230. Truss rod 230 may be adjusted using an adjustment tool at an attachment point between neck assembly 205 and body 202, and/or at an attachment point between neck assembly 205 and head 225.

Figure 3:
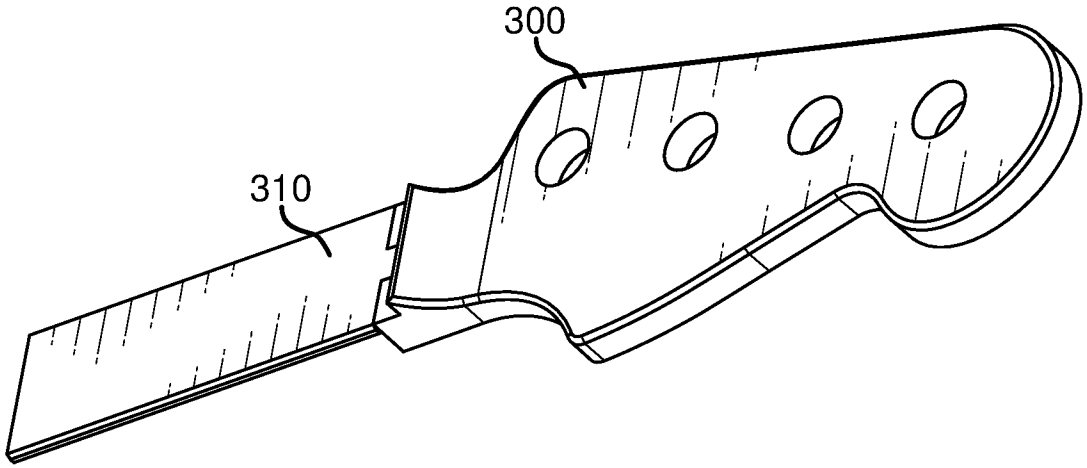
FIG. 3 is a perspective view of a head of a stringed musical instrument coupled to a neck assembly of the stringed musical instrument.

In FIG. 2, head 225 is illustrated as a fork-shaped member. This may reduce a weight of head 225 relative to other designs. The shape of head 225 is not, however, limited to a forked shape. FIG. 3 illustrates another example shape of a head.

FIG. 3 is a perspective view of a head 300 coupled to a neck assembly 310. Head 300 may be cut, formed, or otherwise fabricated into a variety of shapes. Head 300 may, for example, be cut from ⅜ inch 6061 T6 grade aluminum or magnesium. Head 300 may be cut or formed as a single piece, or as multiple pieces that are thereafter joined together.

Figure 4:
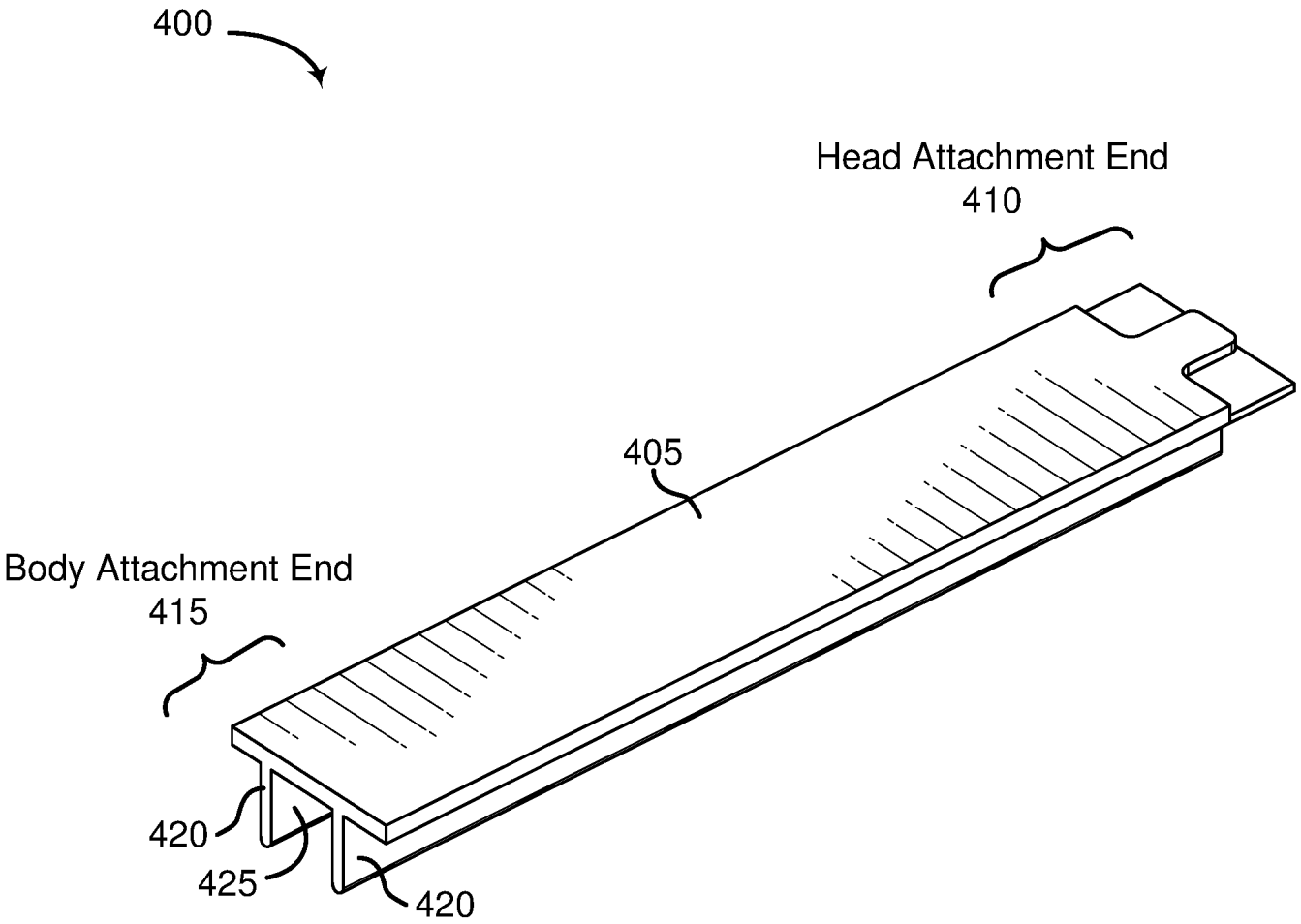
FIG. 4 is a perspective view of an example spine that has a body attachment end to connect to an instrument body, and a head attachment end to connect to an instrument head.

FIG. 4 is a perspective view of an example spine 400 that has a body attachment end 415 to connect to an instrument body, and a head attachment end 410 to connect to an instrument head. In the example of FIG. 4, spine 400 includes a top crosspiece 405 and a pair of reinforcing flanges 420 extending along a length of top crosspiece 405. Reinforcing flanges 420 define a channel or groove 425, which may extend along the length of top crosspiece 405.

Spine 400 may be formed via extrusion techniques from aluminum (e.g., aircraft aluminum), or other suitable material(s). Flanges 420 and top crosspiece 405 may be formed integrally with one another. Alternatively, flanges 420 may be welded to top crosspiece 405.

Flanges 420 may be spaced apart from one another such that spine 400 may resist torsional forces associated with warping, as well as longitudinal forces imparted to a neck assembly when strings of a corresponding instrument are tightened.

Features of spine 400 (e.g., dimensions and/or material(s)), may be selected and/or altered for strength and/or tonal quality. For example, and without limitation, top crosspiece 405 and flanges 420, or other members of a neck assembly, may be ribbed to further reinforce the neck assembly against warping, bending, and twisting.

Figure 5:
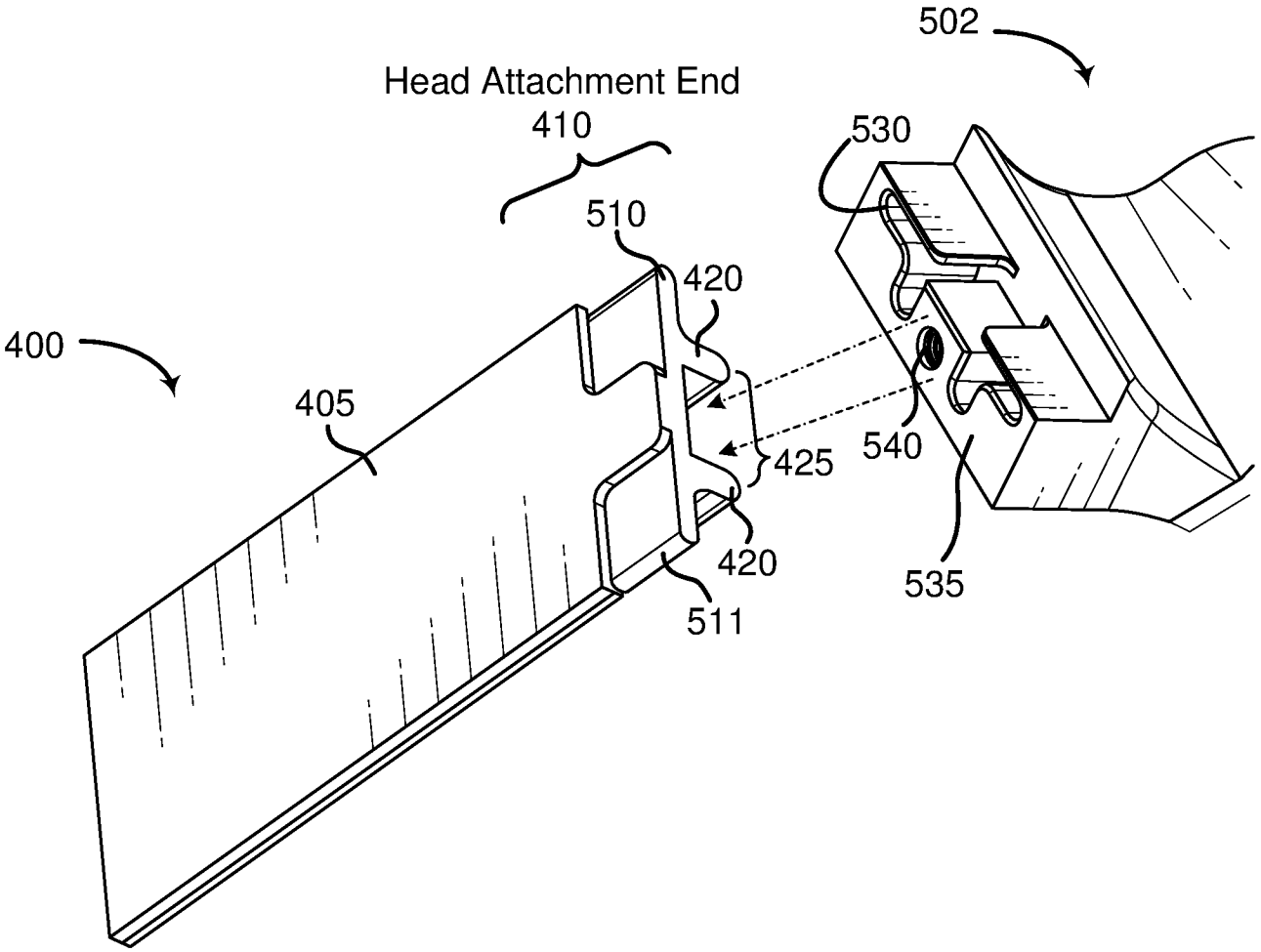
FIG. 5 is a perspective view of the head attachment end of the spine of FIG. 4, and a portion of a corresponding instrument head.

FIG. 5 is a perspective view of head attachment end 410 of spine 400, and a portion of a head 502.

In the example of FIG. 5, head attachment end 410 includes a tenon tongue, illustrated here as including a first pair of flanges 510 and 511 that extend away from one another, and reinforcing flanges 420. Flanges 510 and 511 may be defined in part by recessed regions that are milled from top crosspiece 405.

Further in the example of FIG. 5, a surface 535 of head 525 has an opening 530 to a mortise cavity that is configured to receive the tenon tongue of spine 400.

Further in the example of FIG. 5, a surface 535 has an opening 540 to a threaded cavity that is configured to receive a truss rod. The truss rod may be useful, in part, to releasably secure spine 410 and head 502 to one another. Alternatively, after head attachment end 410 is inserted into the mortise cavity of head 502, head attachment end 410 and head 502 may be welded to one another.

In an alternatively embodiment, a mortise cavity may be provided in neck assembly 400, and head 502 may include a corresponding tenon tongue.

An example dovetail connection is provided below with reference to FIG. 6.

Figure 6:
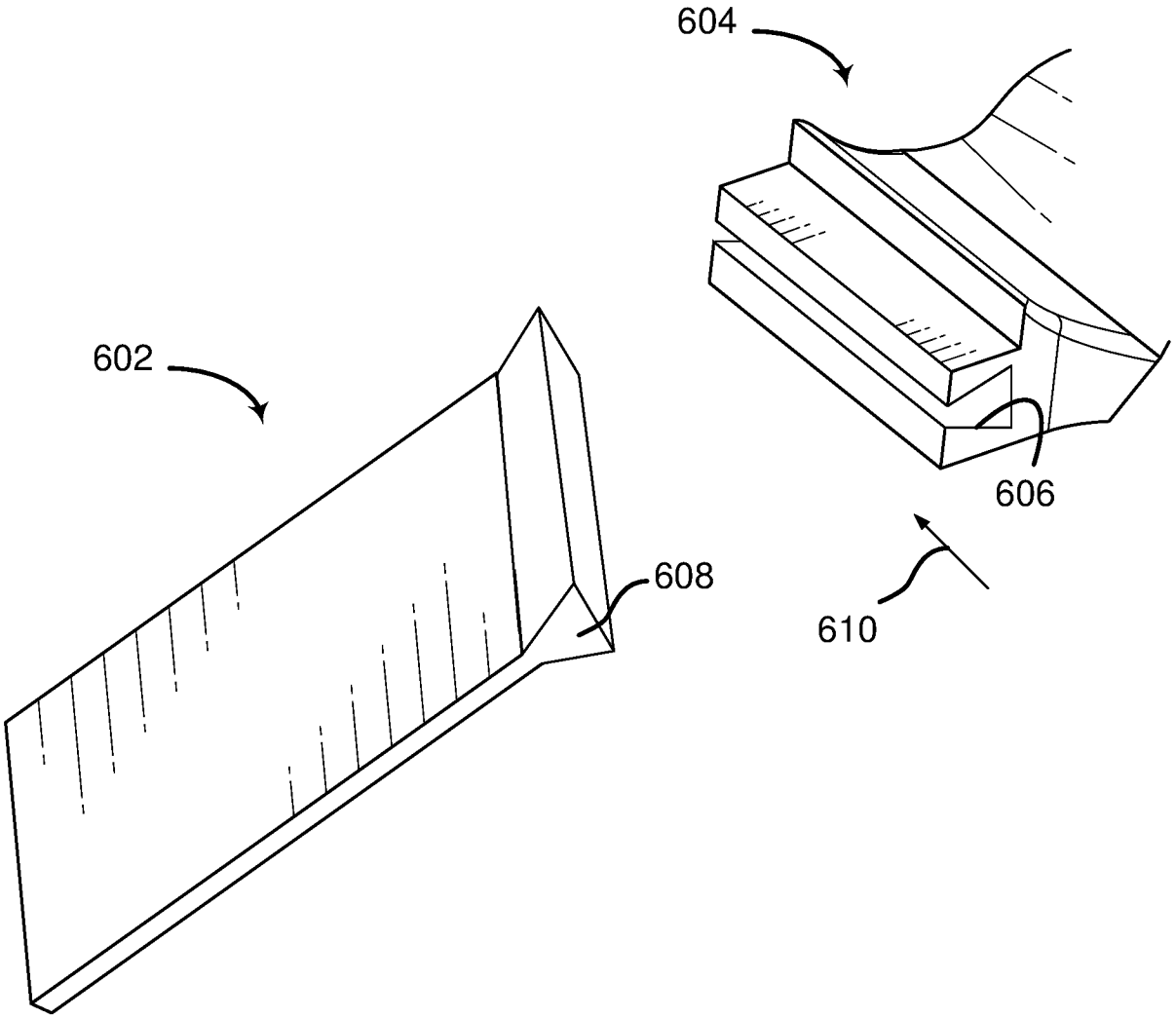
FIG. 6 is a perspective view of a portion of a neck assembly and a head configured to attach to one another with a dovetail joint.

FIG. 6 is a perspective view of a portion of a neck assembly 602 and a head 604 configured to attach to one another with a dovetail joint. In this example, a surface of head 604 has an opening 606 to a trapezoidal-shaped cavity. Further in this example, neck assembly 602 includes a trapezoidal-shaped pin 608 configured to slide through opening 606 and into the trapezoidal-shaped cavity. In this example, pin 608 slides into the trapezoidal-shaped cavity in a direction 610 that is perpendicular to a length of neck assembly 602. Neck assembly 602 may include one or more features disclosed herein with respect to other embodiments of a neck or neck assembly (e.g., reinforcing flanges and/or truss rod).

In an embodiment, a head and a neck, or portions thereof, are made of different metals (e.g., aluminum and magnesium). In FIG. 5, for example, spine 400 may include aluminum and head 502 may include magnesium. This may be useful for reduce the weight of larger heads, such as a head for a bass. Due to difficulties in welding magnesium and aluminum to one another, a mortise and tenon joint, dovetail joint, and/or other type of joint may be particularly useful wherein different metals are to be joined. Methods and systems disclosed herein are not, however, limited to these examples.

In an alternatively embodiment, a trapezoidal-shaped cavity may be provided in neck assembly 602, and head 604 may include a corresponding trapezoidal-shaped pin.

Figure 7:
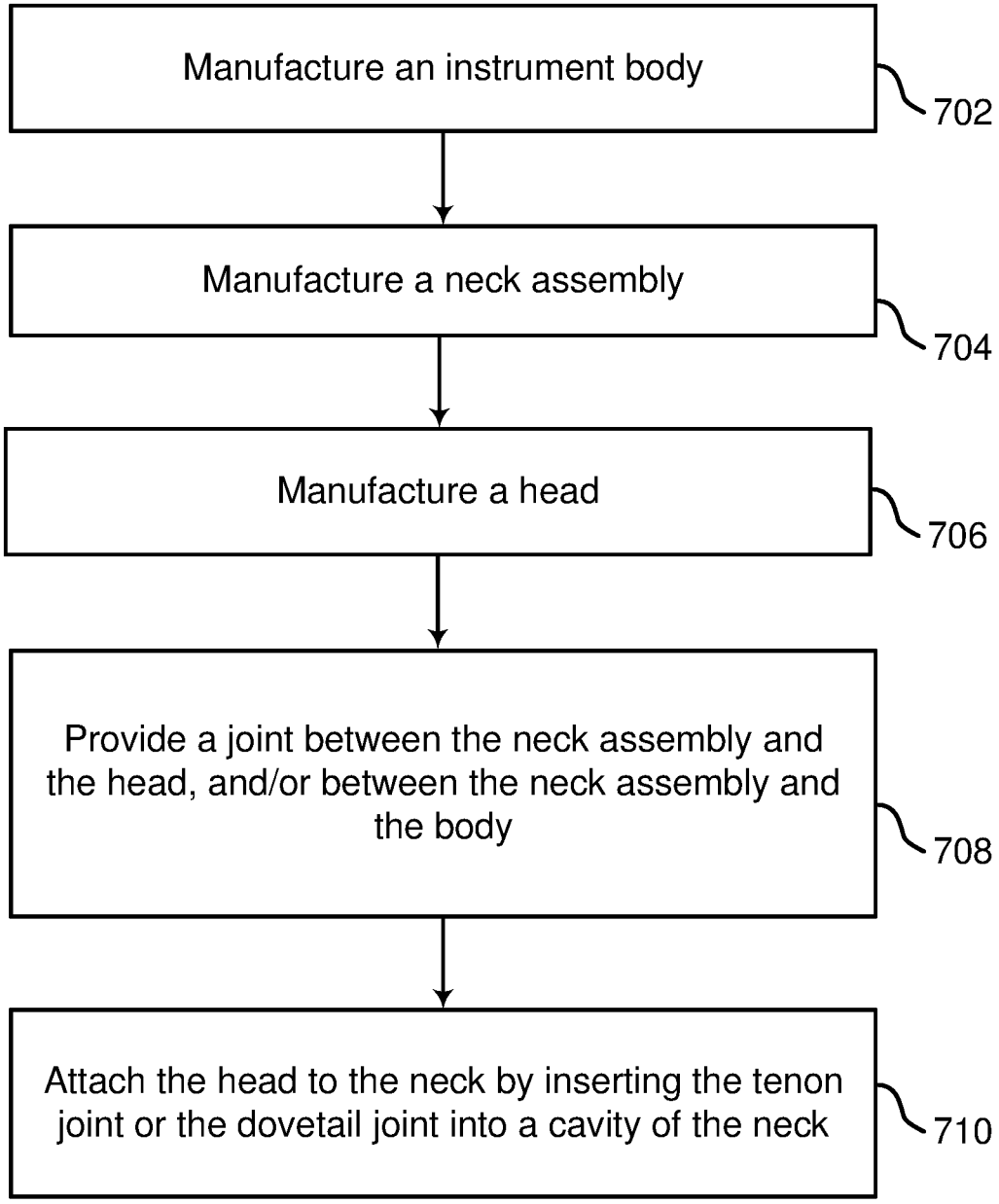
FIG. 7 is a process flowchart of a method of manufacturing a stringed musical instrument.

FIG. 7 is a process flowchart of a method 700 of manufacturing a stringed musical instrument. Methods of manufacturing a stringed musical instrument are not, however, limited to the example of FIG. 7.

At 702, an instrument body is manufactured. The instrument body may be configured as disclosed in one or more examples herein.

At 704, a neck assembly is manufactured. The neck assembly may be configured as disclosed in one or more examples herein.

At 706, a head is manufactured. The head may be configured as disclosed in one or more examples herein.

At 708, a mortise and tenon joint or a dovetail joint is provided between the neck assembly and the head and/or between the neck assembly and the body. The joint may be configured as disclosed in one or more examples herein. The joint may be provided as part of 704 and 706. In an embodiment, a mortise and tenon joint or a dovetail joint is provided between the neck assembly and the head, and the neck assembly and the body are bolted to one another.

At 710, the body, the neck assembly, and the head are connected to one another, such as described in one or more examples herein.

One or more features of method 700 may be performed by a programmable machine and/or special purpose hardware.

Method 700 may include milling metal (e.g., aluminum), such as to provide the joints and/or to provide a truss rod cavity.

Method 700 may include welding over an area of attachment between the body and neck and/or between the neck and the head.

Features disclosed herein may provide for a reinforced (e.g., stronger) neck assembly that is substantially resistant to warpage.

Techniques to attach components of a stringed musical instrument may provide stronger head and neck attachments, which may reduce occurrence of attachment failure (e.g., breaking or snapping of the head or neck may be reduced). Further, interchangeability of instrument heads may provide users (e.g., musicians, musical instrument manufacturers, etc.) increased flexibility in customizing different musical instruments, as different heads can be designed in any shape and to match any instrument.

The description and drawings represent example configurations and do not represent all the implementations within the scope of the claims. For example, features disclosed herein may be rearranged, combined, or otherwise modified. Also, structures and devices may be represented in the form of block diagrams to illustrate relationships amongst components and avoid obscuring the described concepts.

The term "or" as used herein, indicates an inclusive list such that, for example, the list of X, Y, or Z means X or Y or Z or XY or XZ or YZ or XYZ. Also, the phrase "based on" is not used to represent a closed set of conditions. For example, a step that is described as "based on condition A" may be based on both condition A and condition B. In other words, the phrase "based on" shall be construed to mean "based at least in part on." Also, the words "a" or "an" indicate "at least one."

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. A stringed musical instrument comprising:

an instrument body;

a neck extending from the instrument body;

a head;

wherein the head and the neck are configured to attach to one another with a mortise and tenon joint or a dovetail joint; and a tenon tongue positioned within the head or neck, wherein the tenon tongue comprises a pair of flanges extending away from one another.

2. The stringed musical instrument of claim 1, wherein the head and neck are configured to removably attach to one another with the mortise and tenon joint or the dovetail joint.

3. The stringed musical instrument of claim 1, wherein the head and the neck are configured to attach with one another with the mortise and tenon joint, and wherein;

a surface of one of the head or the neck has opening to a mortise cavity; and the other one of the head or neck comprises the tenon tongue extending from a surface thereof configured to slide through the opening and fit within the mortise cavity.

4. The stringed musical instrument of claim 3, wherein the pair of flanges are positioned below recessed regions from a top crosspiece.

5. The stringed musical instrument of claim 3, wherein the tenon tongue comprises a pair of flanges in parallel with one another.

6. The stringed musical instrument of claim 3, wherein the tenon tongue comprises:

a first pair of flanges extending away from one another; and/or a second pair of flanges in parallel with one another.

7. The stringed musical instrument of claim 3, wherein the head comprises the tenon tongue.

8. The stringed musical instrument of claim 3, wherein the neck comprises the tenon tongue.

9. The stringed musical instrument of claim 1, wherein the head and the neck are configured to removably attach with one another with the dovetail joint.

10. The stringed musical instrument of claim 9, wherein:

one of the head or the neck has a trapezoidal-shaped opening to a trapezoidal-shaped cavity; and the other one of the head or neck comprises a trapezoidal-shaped pin configured to slide through the opening and into the trapezoidal-shaped cavity in a direction that is perpendicular to a length of the neck.

11. The stringed musical instrument of claim 9, wherein the head comprises the trapezoidal-shaped pin.

12. The stringed musical instrument of claim 9, wherein the neck comprises the trapezoidal-shaped pin.

13. The stringed musical instrument of claim 9, wherein the body and the neck are configured to attach to one another with a mortise and tenon joint or a dovetail joint.

14. The stringed musical instrument of claim 1, wherein the one of the head and the neck comprises aluminum and the other one of the head and the neck comprises magnesium.

15. An interchangeable musical instrument component, comprising:

a head that has openings in a first surface, each configured to receive a respective tuning key, and a first opening in a second surface configured to receive a tenon tongue or a dovetail pin of a neck assembly, wherein the second surface has a second opening configured to receive an end of a truss rod that extends from the neck assembly.

16. The interchangeable instrument component of claim 15, wherein the truss rod includes a threaded end that extends from the neck assembly.

17. The interchangeable musical instrument component of claim 15, wherein the head comprises aluminum and/or magnesium.

18. A neck assembly for a stringed musical instrument, comprising:

a spine that comprises a top crosspiece and a reinforcing flange extending from a first surface of the top crosspiece;

a grip member attached to the first surface of the spine, wherein the grip member has a channel along a surface thereof configured to receive the reinforcing flange; and a fretted fingerboard attached to a second surface of the top crosspiece;

wherein the spine further includes a tenon tongue or a dovetail pin extending from an end of the spine.

19. The neck assembly of claim 18, wherein the spine comprises aluminum and/or magnesium.

20. The neck assembly of claim 18, further comprising:

a truss rod positioned adjacent the reinforcing flange, wherein an end of the truss rod extends beyond a length of the spine.

* * * * *